US007284618B2

(12) United States Patent
Geddes et al.

(10) Patent No.: US 7,284,618 B2
(45) Date of Patent: Oct. 23, 2007

(54) METHOD AND A DEVICE FOR AUTOMATED CONTROL OF COIL PIPE OPERATIONS

(76) Inventors: Bob Geddes, 155 Solace Ridge Pl. SW., Calgary, Alberta (CA) T3E 6W3; Wayne Kipp, Site 9, Box 32 RR2, Ledue (CA) T9E 2X7

( * ) Notice: Subject to any disclaimer, the term of this patent is extended or adjusted under 35 U.S.C. 154(b) by 302 days.

(21) Appl. No.: 10/905,960

(22) Filed: Jan. 27, 2005

(65) Prior Publication Data

US 2006/0163415 A1 Jul. 27, 2006

(51) Int. Cl.
*E21B 19/22* (2006.01)

(52) U.S. Cl. ..... 166/384; 166/77.2; 166/85.5; 166/385; 242/397.1; 242/566

(58) Field of Classification Search ..... 166/384, 166/385, 77.2, 85.5; 242/397.1, 564.3, 566
See application file for complete search history.

(56) References Cited

U.S. PATENT DOCUMENTS 5,660,235 A * 8/1997 Sola ..... 166/384
6,092,756 A * 7/2000 Sola ..... 242/399.2
6,516,892 B2 * 2/2003 Reilly ..... 166/384
6,814,149 B2 * 11/2004 Liess et al. ..... 166/380
2006/0000619 A1 * 1/2006 Borst et al. ..... 166/384

* cited by examiner

*Primary Examiner*—Gene O. Crawford
*Assistant Examiner*—Sang Kim
(74) *Attorney, Agent, or Firm*—Bay Area Patent Group, LLC

(57) ABSTRACT

An apparatus and automated control of the apparatus for use in coiled pipe operations is provided. The apparatus includes a mobile rig or trailer that carries a tower having attached thereto a reel of coiled tubing and a standard coiled tubing injector. The tower is positionable to support the reel of coiled tubing and the injector at a desired elevation above a wellhead. The reel of coiled tubing is supported upon a movable reel cart which is actively positioned by an automated control system to position the reel of coiled tube and ultimately the coiled tubing as it drawn from and drawn upon the reel during operation. The control system monitors the position of the coiled tube as it is passed through the injector and positions the reel cart to minimize the number of bends the coiled tubing is subjected to during one complete iteration of running in and withdrawal.

12 Claims, 3 Drawing Sheets

METHOD AND A DEVICE FOR AUTOMATED CONTROL OF COIL PIPE OPERATIONS

BACKGROUND OF THE INVENTION

The present invention relates generally to coiled pipe operations. More particularly, relating to a method for the automated control of coiled pipe operation and a device for implementing the method.

Coil pipe operation involves the uncoiling and recoiling of a coil pipe from and onto a rotatable reel through the use of an injector. The coil pipe is typically uncoiled from the reel by the injector which feeds the coil pipe into a well for performing operations in the well, such as drilling and/or well servicing. Once the well operations, or down hole operations, are completed the coil pipe is removed from the well and recoiled back onto the reel by the injector.

During this operation, the coil pipe is subjected to many bend related stresses resulting from the uncoiling and recoiling of the coil pipe. In prior art coil pipe operations, the reel is typically placed at an elevation below the injector and at a spaced distance from the injector. With this arrangement, a device commonly named in the art as a "gooseneck" is implemented to raise the coil pipe from the elevation of the reel to an elevation above the injector. While the use of a gooseneck has been successful in coil pipe operations, the use of it causes the coil pipe to be subjected to three bends as is drawn from the reel into the injector. Additionally, the coil pipe is subjected to the same three bends as it is recoiled back onto the reel from the injector. The large number of bends prematurely fatigues the coil pipe and as a result the coil pipe is reduced to a limited number of iterations it can be used in coil pipe operations.

A method of addressing the deficiencies of the prior art is described in U.S. Pat. No. 5,660,235, the entire of which is incorporated herein by reference.

SUMMARY OF THE INVENTION

In accordance with the present invention, a method of automatic control of coil pipe operations and a device for implementing the method is provided.

The preferred embodiment of the present invention provides for an apparatus and method of automated control of the apparatus for running in and withdrawing coiled tubing.

The apparatus includes a mobile rig or trailer that carries a tower having attached thereto a reel of coiled tubing and a standard coiled tubing injector. The tower is positioned in a lowered pivoted position along the length of the trailer during transport and then is pivoted about the trailer and raised into an in-use position, thereby positioning the reel of coiled tubing and the injector at a desired elevation above a well head.

The reel of coiled tubing is supported by a movable reel cart which is operated to position the reel of coiled tubing to reduce the number of bends the coiled tubing is subjected to during injection and withdrawal of the tubing from the well. The positioning of the reel is such that the coiled tubing is only subjected to two bends during one complete iteration of injection and withdrawal.

More specifically, the reel cart is actively positioned to control the positioning of the reel and ultimately the coiled tubing as it is unwound and rewound onto the reel through the use an automated control system and positioning means. The control system and positioning means operate to tilt and translate the reel cart so as to maintain an axial center line of the coiled tubing about a desired and predetermined reference point with respect to the injector an the reel.

Broadly, the method of automatic control of coil pipe operations includes a coil pipe that is coiled upon on a reel that is to be uncoiled from and recoiled thereupon, the coil pipe having an axial centerline and the a reel having a longitudinal axis that is normal to the axial centerline, an injector for effecting the coiling/uncoiling of the coil pipe, the reel being positioned and aligned with respect to the injector such that axial centerline of the coil is passed through the injector approximate a center point so that the axial centerline creates a tangential line that extends from the reel through the injector, the method comprising the steps of:

measuring the displacement of the coil pipe axial centerline with respect to the center point as the coil pipe is uncoiled from or coiled onto the reel; and tilting the reel about an axis parallel to the longitudinal axis of the reel based upon the measured displacement to bring the axial centerline within a predetermined distance from the center point.

The method can further include the step of translating the reel back and forth along a path parallel to the longitudinal axis of the reel based upon the measured displacement to bring the axial centerline within a predetermined distance from the center point.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERED EMBODIMENTS

Figure 1:
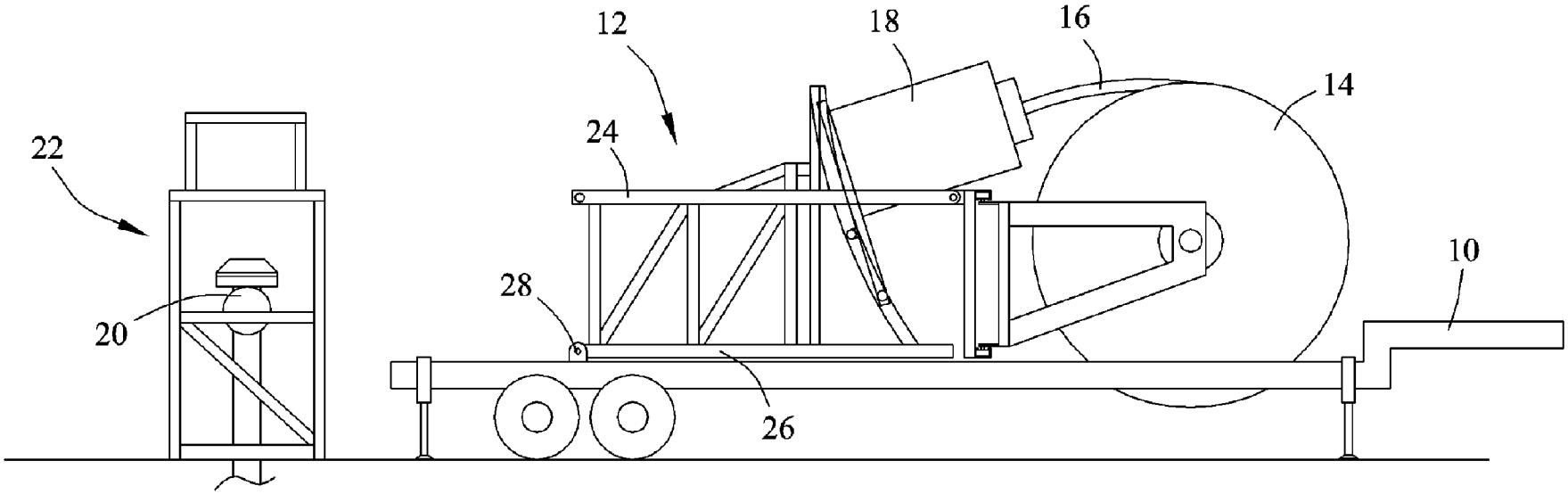
FIG. 1 is a side elevation of a mobile trailer carrying a tower having attached thereto a reel cart carrying a coil tubing reel of coiled tube, and an injector cart carrying an injector for the coil tubing, the mobile trailer is positioned juxtaposed an already installed blowout preventer and drilling rig substructure, and the tower is positioned in a lowered, transport position.

With reference to FIG. 1, there is shown a preferred embodiment of the present invention, which includes a mobile trailer 10 that is adapted to support a tower 12 which attached thereto is a coil tubing reel 14 of coiled tubing 16, and a coil tubing injector 18. The trailer 10 is shown in position next to an already installed blowout preventer 20 and a sub structure 22 that is positioned about the blowout preventer. The sub structure 22 can be part of an additional mobile rig or can be a stationary structure.

The tower 12 includes lower supports 24 and 26 and is pivotally secured to the trailer 10 by a jointed coupling 28 made between the trailer and the support 26. The tower 12, shown in a lowered position, is pivotal about the jointed coupling 28 so that the tower can be swung thereabout into a raised position, thereby lifting the reel 14 and the injector 18 into a working position above the blowout preventer 20.

Figure 2:
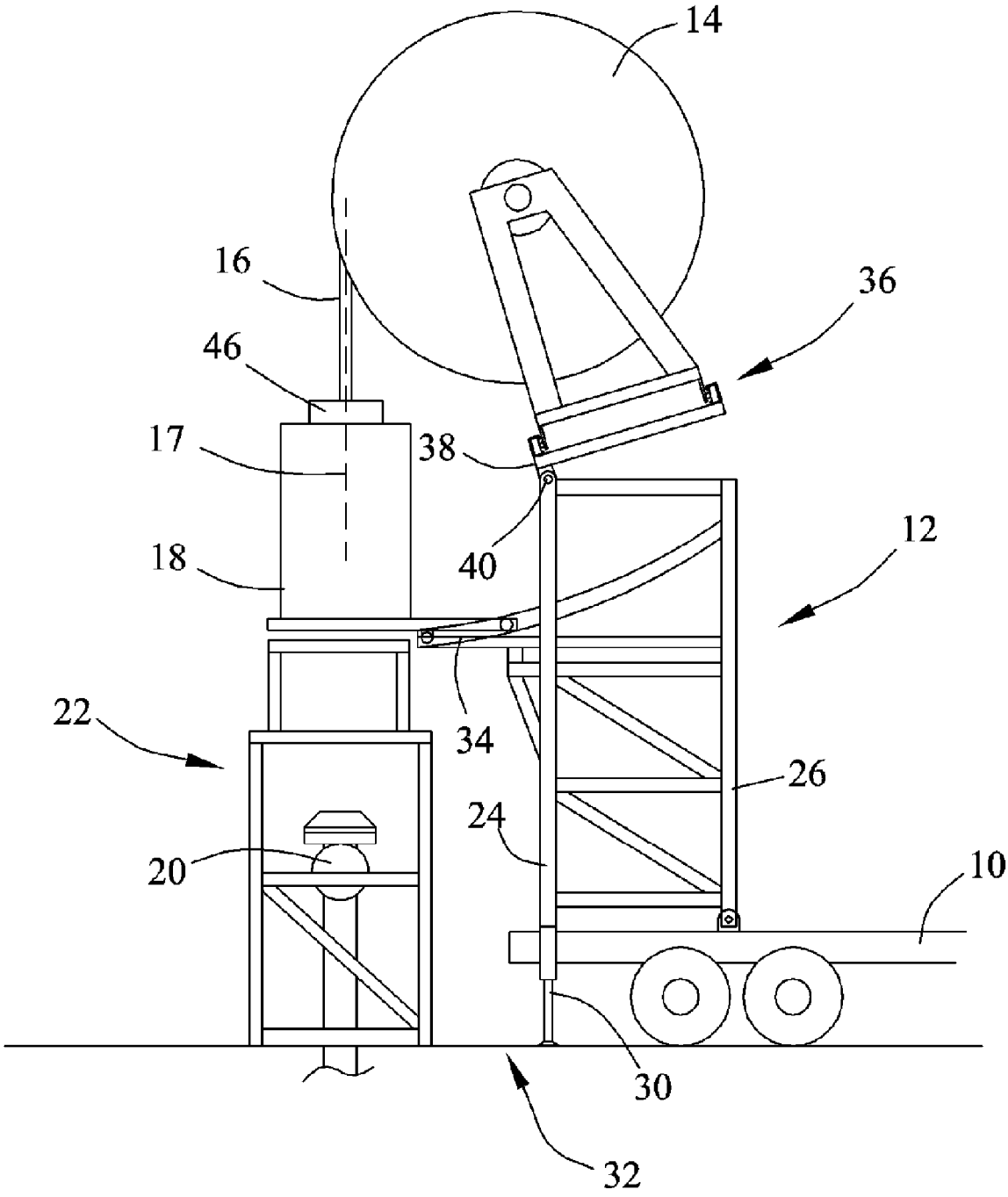
FIG. 2 is a side elevation of the same components of FIG. 1, but with the tower in a raised, in-use position, were the tower is rotated into a raised position by a raising means.

Turning now to FIG. 2, the tower 12 is shown in a raised position with the reel 14 and the injector 18 in an in-use position above the blowout preventer 20. The tower 12 can be raised by a hydraulic ram (not illustrated). The support 24 is engaged with the trailer 10 about a landing gear 30, which is engaged with the ground surface 32.

The injector 18 is attached to an extendable and retractable support 34. The support 34 is extended from a retracted location to position the injector 18 directly above the blowout preventer 20. By utilizing an extendable support 34 to position the injector 18, the trailer 10 can be brought into an approximate position about the blowout preventer 20 and the final placement of the injector is caused by extending and retracting the support 34. With this arrangement, the injector 18 is quickly and precisely positioned without requiring movement of the trailer, where small increments of motion are difficult to achieve.

A reel cart assembly 36 rotatably supports the reel 14, so that the reel can be rotated about its longitudinal axis to dispense and take-up tubing 16. The reel cart assembly 36 is pivotally connected at its forward end 38 to the tower 12 about joint 40, which has a horizontal rotary axis that is parallel to the longitudinal axis of the reel 14. In addition, the reel cart assembly 36 is able to translate side to side along a path that is parallel to the longitudinal axis of the reel 14.

The reel cart assembly 36 is tilted about pivot joint 40 to bring the reel 14 in position above the injector 18. The reel 14 is positioned so that during running in and take up of the coiled tubing 16, the axial center line 17 of the coiled tubing creates a imaginary tangent line that extends from the reel through the injector. The reel cart assembly 36 is continuously pivoted forward and backward about joint 40 as the coiled tubing is drawn from or drawn back onto the reel 14 to maintain the tangential line to reduce the number of times the coiled tubing 16 is bent. With this arrangement, a finite length of coiled tubing is reduced to two bending actions; one when the coiled tubing 16 is dispensed from the reel 14, and the second, when the coiled tubing is drawn back onto the reel. By reducing the number of times the coiled tubing 16 is bent through a single iteration of dispensing and take-up, the service life of the tubing is increased substantially.

Figure 3:
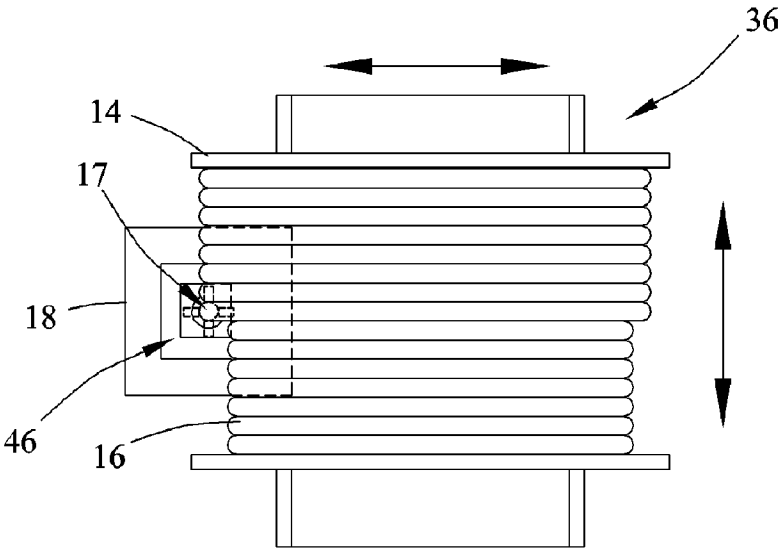
FIG. 3 is a top plan view of the coiled tubing reel positioned above the well.

With reference now to FIG. 3, the reel cart assembly 36 is translated side to side along a path that is parallel to longitudinal axis of the reel 14 as the coiled tubing 16 is dispensed from or drawn back onto the reel so that the coiled tubing is coiled evenly across the length of the reel and so that lateral bending of the tube is prevented. In some prior art devices, the operation of coiling the tubing evenly across the length of the reel is effected by deflectors which cause the tubing to bend laterally to direct the tubing back and forth across the reel. This prior art method creates large amounts of bending stress in the tubing, which results in premature failure of the tubing and expensive repair and replacement costs. As such, by making the tubing laterally static and the reel laterally dynamic, lateral bending stress is prevented in the coiled tubing.

Figure 4:
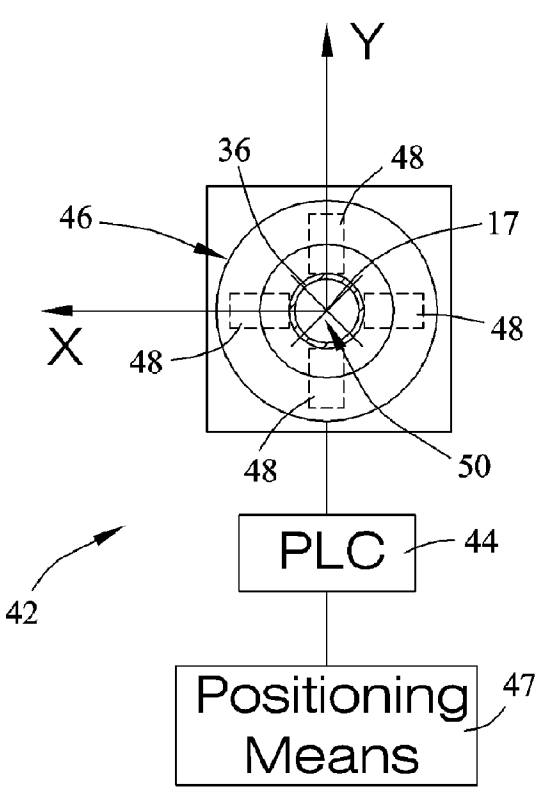
FIG. 4 is a schematic diagram of a control system for automatically controlling the positioning of the coiled tubing reel that keeps the reel centered above the injector mechanism.

With reference to FIGS. 3 and 4, the operation of tilting and translating the reel cart 36 to maintain the desired placement of the coiled tubing 16 about the injector 18 is controlled through an automatic control system 42. The control system 42 includes a programmable logic controller (PLC) 44, a sensor array 46 and positioning means 47 for controlling the position of the reel cart assembly 36. The axial position 17 of the coiled tubing 16 as it is drawn into and out of the blowout preventer 20 by the injector 18 is continuously monitored and measured by the sensor array 46 which can be positioned directly above the intake of the injector. The sensor array 46 is equipped with a plurality of position sensors 48, such as a rod-type linear transducers, that in a Cartesian coordinate system, sense and measure the axial centerline 17 position of the coiled tubing 16 with respect to a center point 50 (the origin of the coordinate system) as it is passed through the injector 18. The center point 50 is a static position or reference point with respect to the injector 18 and is placed about the center of the injector's through passage.

The control system 42 operates to maintain the axial centerline 17 position of the coiled tubing 16 about the center point 50 by actively controlling the tilt and the longitudinal position of the reel cart 36, thereby controlling the positioning of the spool relative to the injector 18. The tilt of the reel cart 36 is effected by measuring the displacement of the axial centerline 17 position of the coiled tubing along the X-axis and the displacement of the axial centerline position of the coiled tubing along the Y-axis effects the longitudinal positioning of the reel cart.

For example, as the coiled tubing 16 is drawn from the reel 14 through the injector 18, the axial centerline 17 position of the coiled tubing will drift along the X-axis in the negative direction as a result of a decreasing coiled tubing diameter on the reel 14. This drift is sensed and the displacement from the center point 50 is measured by the sensor array 46, which transmits a position signal to the PLC 44. The PLC 44 will process the signal against the center point reference 50 and then generate and transmit a command signal to the positioning means 47 to increase the tilt of the reel cart 36. The tilt of the reel cart 36 will continue to be increased until the PLC 44 process a centered position signal from the sensor array 46. Likewise, the control system 42 will operate to control the tilt of the reel cart 36 as the coiled tubing 16 is drawn back onto the reel 14.

Similarly, the longitudinal positioning of the reel cart 36 is controlled in the same manner, but with the drift of the axial centerline 17 position of the coiled tubing 16 along the Y-axis being the controlling variable.

Figure 5:
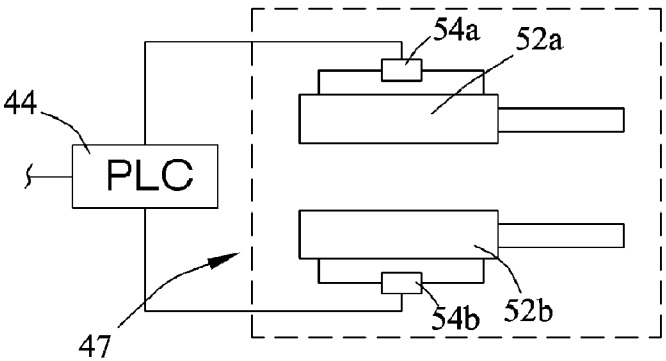
FIG. 5 is a schematic diagram of a positioning means for effecting the position of the reel cart.

With reference to FIG. 5, the positioning means 47 includes a pair of hydraulic cylinders 52*a* and 52*b* and a proportional valve 54*a* and 54*b* for each cylinder. One cylinder is operated to control the tilt of the reel cart 36 and the other is operated to control the longitudinal position of the reel cart. In use, the command signal generated by the PLC 44 operates the proportional valve of each cylinder to either extend or retract the cylinder to effect the correct positioning of the reel cart. Each proportional valve 54*a* and 54*b* can include a linear transducer to monitor the position of each respective spool to increase accuracy in positioning of the reel cart 36. For safety, the linear transducers would be included in a closed loop feedback control scheme and monitor the spool location of each proportional valve 54*a* and 54*b*. Additionally, in the event of a cable break a zero command signal would be sent to each proportional valve to halt the operation of each hydraulic cylinder 52*a* and 52*b*. While the use of hydraulic cylinders is preferred, other devices such as stepper motor systems or the like could be used.

The rate at which the hydraulic cylinders 52*a* and 52*b* are extended and retracted to position the reel cart 14 so as to maintain the axial centerline 17 of the coiled tubing 16 within a predetermined distance approximate the center position 50 is proportional to the rate at which the injector 18 is operating to either inject or remove the coiled tubing from the well.

While a preferred embodiment of the present invention has been described. Nevertheless, it will be understood that various modifications may be made without departing from the spirit and scope of the invention. Accordingly, other embodiments are within the scope of the following claims.

What is claimed is:

1. An automatic control method for use in coil pipe operations including a coil pipe that is coiled upon on a reel and that is to be uncoiled from and recoiled thereupon, the coil pipe having an axial centerline and the reel having a longitudinal axis, an injector for affecting the coiling/uncoiling of the coil pipe, the reel being positioned and aligned with respect to the injector such that axial centerline of the coil is passed through the injector approximate a center point so that the axial centerline creates a tangential line extending from the reel to the injector, the method comprising the steps of:

measuring the displacement of the coil pipe axial centerline with respect to the center point as the coil pipe is uncoiled from or coiled onto the reel; and tilting the reel about an axis parallel to the longitudinal axis of the reel based upon the measured displacement to bring the axial centerline within a predetermined distance from the center point.

2. The method of claim 1, further comprising the step of:

providing a control system including:

a sensor array;

a programmable logic controller;

a positioning means;

said sensor array positioned to effect the measurement of the axial centerline displacement from the center point and generate a signal in response to the measurement;

said programmable logic controller processing the signal and generating a command signal; and said positioning means is adapted to receive the command signal and operating to control the tilting of the reel based upon the command signal.

3. The method of claim 1, further comprising the step of:

translating the reel back and forth along a path parallel to the longitudinal axis of the reel based upon the measured displacement to bring the axial centerline within a predetermined distance from the center point.

4. The method of claim 3, further comprising the step of:

providing a control system including:

a sensor array;

a programmable logic controller;

a positioning means;

said sensor array positioned to effect the measurement of the axial centerline displacement from the center point and generate a signal in response to the measurement;

said programmable logic controller processing the signal and generating a command signal; and said positioning means adapted to receive the command signal and operating to control the tilting of the reel and the translation of the reel based upon the command signal.

5. The method of claim 1, wherein the step of measuring the axial centerline displacement is operated continuously.

6. The method of claim 1, wherein the step of measuring the axial centerline displacement is operated intermittently.

7. A device for the automatic control of coil pipe operations involving the uncoiling and recoiling of a coil pipe from a reel through the use of an injector, the coil pipe having an axial centerline and the reel having a longitudinal axis, the device comprising:

a reel cart for rotatably receiving the reel and for positioning the reel such that the coil pipe is received by the injector so that the axial centerline of the coil pipe as it is uncoiled from or recoiled onto the spool is passed through the injector approximate a center point with respect to the injector, thereby causing the axial centerline of the coil pipe to create a tangent line extending from the reel to the injector; and a control system, said control system measuring a displacement of the axial centerline of the coil pipe from the center point of the injector, and affecting the positioning of said reel cart to maintain the axial centerline of the coil pipe within a predetermined displacement from the center point of the injector.

8. The device of claim 7, wherein said reel cart is pivoted about a horizontal axis that is parallel to the longitudinal axis of the reel, and is translated from side-to-side along a path parallel to the longitudinal axis of the reel to maintain the axial centerline approximate the center point.

9. The device of claim 7, further comprising:

a tower, said tower supporting the reel cart and injector in a raised position.

10. The device of claim 9, further comprising:

a mobile trailer, said tower pivotally attached to said mobile trailer and positionable in either a lowered, transport position or a raised, in-use position.

11. The device of claim 7, wherein the control system comprises:

a sensor array for measuring the displacement of the axial centerline from the center point and generating a signal in response to the measured displacement;

a programmable logic controller for receiving the signal from the sensor array and processing it to generate a command signal; and a positioning means for positioning said reel cart, said positioning means adapted to receive the command signal and position said reel cart based upon the command signal.

12. The device of claim 11, wherein said positioning means includes:

a pair of hydraulic cylinders, one is operated to control the tilt position of said reel cart, and the second is operated to control the translation of said reel cart; and a pair of proportional valve, one attached to each said pair of hydraulic cylinders to control the extension and retraction thereof in response to the command signal.

* * * * *